United States Patent [19]

Iwata

[11] Patent Number: 4,627,131

[45] Date of Patent: Dec. 9, 1986

[54] COMBING ROLLER FOR AN OPEN-END SPINNING MACHINE

[75] Inventor: Kunio Iwata, Itami, Japan

[73] Assignee: Kanai Juyo Kogyo Co., Ltd., Hyogo, Japan

[21] Appl. No.: 753,877

[22] Filed: Jul. 11, 1985

[51] Int. Cl.[4] ..... D01G 15/84

[52] U.S. Cl. ..... 19/97; 19/112; 19/114

[58] Field of Search ..... 19/97, 112, 114, 113

[56] References Cited

U.S. PATENT DOCUMENTS

| | | | |
|---|---|---|---|
| 3,646,639 | 3/1972 | Burckhardt et al. | 19/97 |
| 4,392,276 | 7/1983 | Gauvain et al. | 19/112 X |
| 4,394,789 | 7/1983 | Egerer | 19/97 |

*Primary Examiner*—Louis K. Rimrodt

*Attorney, Agent, or Firm*—Wenderoth, Lind & Ponack

[57] ABSTRACT

A combing roller for an open-end spinning machine which utilizes whirling airflow. The roller has on its circumferential surface and in its axial direction dovetail grooves, in which needle plate laminated members which have needle rows in the axial direction of the roller are removably mounted so that each needle row can be mounted and removed simply. The needle plate laminated member is made by connecting together in a row a plurality of needle plates, with a spacer between adjoining ones in some cases, by a connecting member. The needle plate has at its upper part a needle base portion with at least one needle head and at its lower part a needle insertion portion with a dovetail shape to be fitted in a dovetail groove with the roller, having at the substantially central part of its bottom a part in which the connecting member is inserted and fastened.

6 Claims, 14 Drawing Figures

COMBING ROLLER FOR AN OPEN-END SPINNING MACHINE

BACKGROUND OF THE INVENTION

1. Field of the invention

This invention relates to the construction of a combing roller for an open-end spinning machine which utilizes whirling airflow.

2. Prior art

The conventional combing roller has a construction in which metallic wire is wound upon a roller body and pressed into a helical groove formed in the circumferential surface of the roller body. Since the combing roller opens sliver being fed at a high speed of several thousands revolutions per minute, it has been a usual practice to fix the metallic wire in a helical groove of the roller body by caulking so as to have the combing roller withstand high speed running. However, the combing roller of this kind has had such disadvantages that it requires much trouble for the caulking operation during winding of the metallic wire and the helical groove in which metallic wire is received breaks during roller running and becomes unfit for reuse. A further disadvantage has been that if the metallic wire is damage, it is impossible to repair or replace only the damaged part for reuse but rather the whole roller must be replaced.

In order to overcome the above-mentioned disadvantages, a combing roller using tooth segments having a shape obtained by dividing a circularly shaped metallic wire into two–six segments, instead of the above-mentioned metallic wire, has been suggested (U.S. Pat. No. 4,394,789, for example). This combing roller has a construction in which dovetail elements (holding members) running parallel to the axis are disposed upon the circumferential surface of a roller body, a dovetail groove is formed at substantially the central part of the bottom of each of the above-mentioned tooth segments and the dovetail groove is pushed upon dovetail elements (holding members) successively to arrange tooth segments in plural rows upon the roller. This arrangement, however, requires much work for fitting each tooth segmet into dovetail elements (holding members) on the roller body and also for providing dovetail elements.

An object of the present invention is to overcome the above problems and to provide combing rollers which can easily be mounted on and detached from the roller body at each needle row in an axial direction.

SUMMARY OF THE INVENTION

The combing roller according to the present invention has a construction in which needle plates in a laminated assembly which form needle rows in an axial direction are removably fitted in grooves formed, at certain intervals, on the circumferential surface of the roller body in an axial direction. The needle plate laminated member consists of a plurality of needle plates which are connected together with a connecting member, through the medium of spacers in some cases. Each needle plate is composed of a needle base portion with at least one needle head and a needle insertion portion of the same shape as the dovetail element to be fitted in the groove of the roller body. The needle insertion portion has a receiving part at the substantially central part of its bottom for holding a connecting member.

The above-mentioned connecting member is a band-like member made of metal, synthetic resin or the like which is inserted in receiving parts of needle insertion portions of a needle plate laminated member composed of a plurality of needle plates and is fastened by pouring adhesive into the gap between the band-like member and the receiving parts. However, the same purpose can be attained by fitting a band-like member tightly in the receiving parts, by pouring adhesive, lead, solder or the like into the receiving parts for fastening without using the above-mentioned band-like member, by compressing and fitting a member of elastic material into the receiving parts and then releasing it, by fitting a member made of shape-memory alloy into the receiving parts and then transforming it, and the like.

BRIEF EXPLANATION OF THE DRAWINGS

The nature and advantages of the present invention will become more apparent from the following description given with reference to the accompanying drawings, in which:

FIG. 1A to FIG. 4 show various needle plates for use in a needle plate laminated member for use in a combing roller according to the present invention, in which FIG. 1A is a front view of one example of a needle plate.

FIGS. 6A–6C show an example of a needle plate laminated member using the needle plates shown in FIG. 1 and FIG. 2 and the spacer shown in FIG. 5, in which FIG. 6A is a front view, FIG. 6B is a cross section, taken along the line VI—VI in FIG. 6A and FIG. 6C is a plan view;

FIGS. 8A and 8B show one embodiment of the combing roller of the invention, in which FIG. 8A is an end view and FIG. 8B is an end view of a part of the combing roller, on an enlarged scale.

DETAILED DESCRIPTION OF THE INVENTION

Preferred embodiments

On the circumferential surface of the combing roller for an open-end spinning machine according to the present invention, a group of needle rows is formed by a plurality of needle plate laminated members, each comprising a plurality of needle plates 1 connected together by a connecting means 7 and having through spacers therebetween in some cases.

Figure 1A:
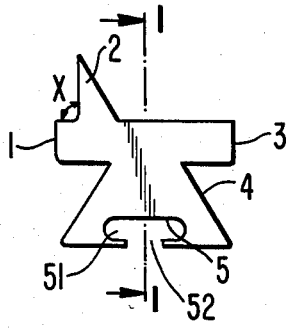
Figure 1B:
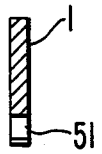
FIG. 1B is a cross section, taken along the line I—I in FIG. 1A.

As shown in FIG. 1A and FIG. 1B, the needle plate 1 consists of a needle base portion 3 of substantially rectangular shape having a needle head 2 on the top or radially outer side near one or the other end of the top and a needle insertion portion 4 with dovetail-like shape on the bottom or radially inner part. This needle plate is stamped out from a sheet metal in such a fashion that the needle insertion portion 4 has a receiving opening 5 at the substantially central part of its bottom. As shown in the drawings, the receiving opening 5 consists of a aperture 51 of the desired shape, here shown as an oval shape, but which can be a circular shape, triangular shape, square shape or the like, and a slit 52 opening out of the bottom edge from the hole 51.

The working angle X at the needle head of the needle plate 1 is set at 60°–75° for cotton and 75°–100° for chemical fiber and synthetic fiber. In order to have the needle head 2 maintain a good fiber opening function for a long period of time, the needle head 2 is specially treated with an abrasion-resistance surface treatment.

Figure 3:
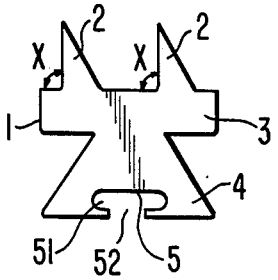
Figure 2A:
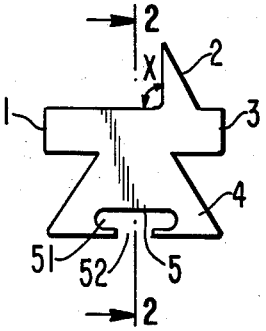
FIG. 2A is a front view of another example of a needle plate.
Figure 2B:
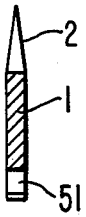
FIG. 2B is a cross section, taken along the line II—II in FIG. 2A, and FIG. 3 and FIG. 4 are front views of other embodiments of needle plates.
Figure 4:
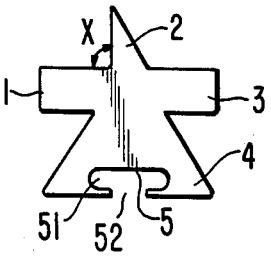
Figure 5:
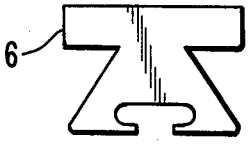
FIG. 5 is a front view of a spacer.

FIG. 3 and FIG. 4 show respectively an example of a needle plate which has a different number of needle heads and a different position of needle head. The needle plate 1 shown in FIG. 3 has two needle heads 2, at the front end and the rear end of the needle base portion 3. The needle plate 1 shown in FIG. 4 has a needle head 2 at the substantially central part of the needle base portion 3. It will be understood that assembling a stack of the proper combination of needle plates of different types or the same type, including spacers 6 in some cases, a needle plate laminated member with the desired needle head arrangement and the desired needle head density can be obtained.

The spacers 6 are made of synthetic resin in the shape analogous to the needle base portion 3 (excepting a needle head) and the needle insertion portion 4 of the needle plate 1.

Figure 6A:
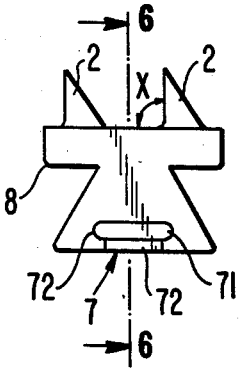
Figure 6B:
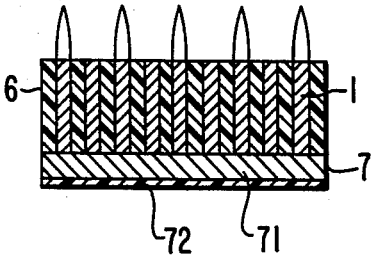
Figure 6C:
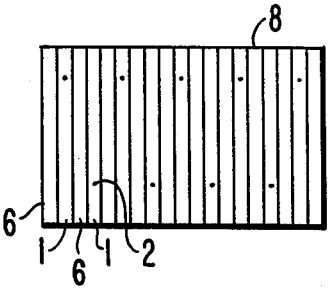

FIGS. 6A–6C show an example of a needle plate laminated member. This needle plate laminated member 8 has a construction in which a plurality of needle plates 1 shown in FIGS. 1A–2B are connected together by a connecting means 7 with a spacer 6 between each two needle plates. More particularly, the needle plate laminated member 8 has a construction in which a plurality of needle plates 1 are so arranged that needle heads 2 of adjoining needle plates 1 are in a zigzag fashion with spacers 6 therebetween, the holes 51 of both the needle plates 1 and the spacers 6 being fitted successively on a band-like member 71 made of metal or synthetic resin which serves as the connecting means 7 and adhesive 72 is poured into the groove-like recess composed by a plurality of the slits 52 for locking the assembly together, thereby connecting together a plurality of needle plates and spacers 6 by the connecting means 7.

An embodiment of a combing roller using the above-described needle plate laminated members 8 according to the present invention is described below, with reference to FIG. 7 and FIGS. 8A and 8B.

Figure 7:
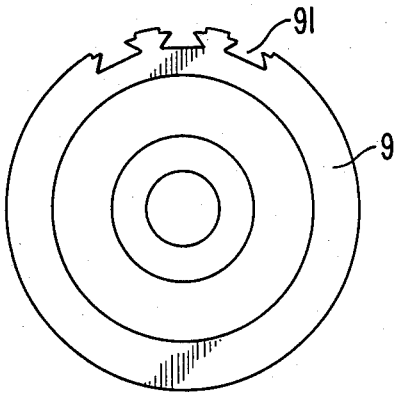
FIG. 7 is an end view of the roller body.
Figure 8A:
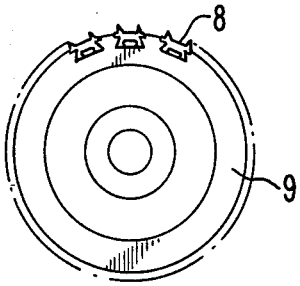
Figure 8B:
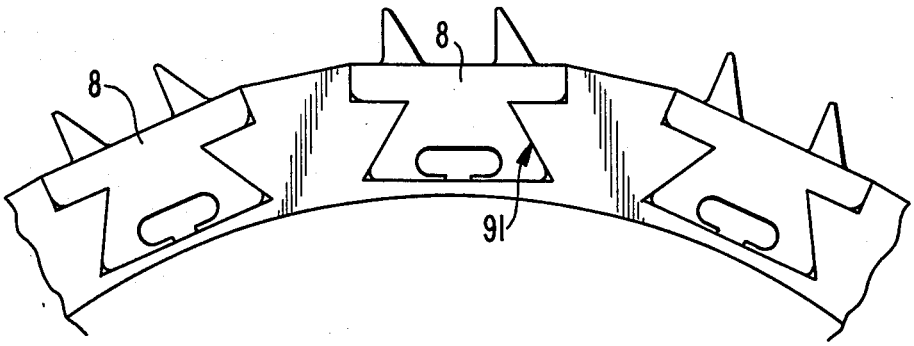

As shown in FIG. 7, grooves 91 in which a group of needle base portions 3 and a group of needle insertion portions 4 of the needle plate laminated member engage are made on the circumferential surface of a roller body 9 extending in a direction parallel to the axis of the roller at a certain circumferential. Then, the needle plate laminated members 8 are fitted removably in the grooves 91 of the roller body in the direction parallel to the axis of the roller to compose the desired combing roller (FIG. 8A). Both ends of the roller body are provided with a flange (not shown in the drawings).

In this embodiment, because the groove 91 of the roller body is so shaped as to receive exactly a group of needle base portions and a group of needle insertion portions, the needle plates are fixed more accurately.

Figure 9:
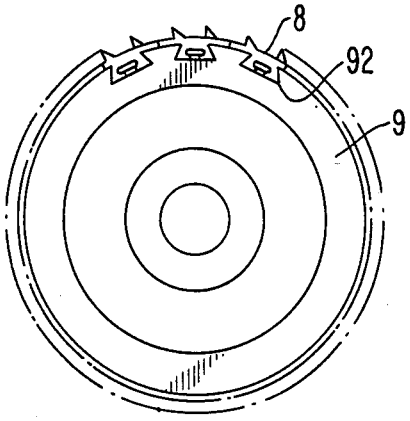
FIG. 9 is an end view of another embodiment of the combing roller.

FIG. 9 shows another embodiment of the combing roller according to the present invention. The roller body 9 has in its circumferential surface grooves 92 of dovetail-like shape in which only a group of needle insertion portions are fitted. The needle plate laminated members are fitted removably in the grooves 92 parallel to the direction of the axis of the roller and both ends of the roller are provided with flanges (not shown in the drawings). Thus, a combing roller is formed.

In this embodiment, adjoining needle plate laminated membes contact each other at the front and the rear ends of respective needle base portions.

According to this embodiment, the combing roller has grooves of dovetail shape to receive only needle insertion portions therein and therefore groove processing is easy and the needle depth can be varied simply by changing the height of the needle base portion. Moreover, since adjoining needle plate laminated members contact tightly with each other at the front and the rear ends of the needle base portion, it is possible to provide needle heads in a dense arrangement in a circumferential direction. High density of needle heads is more suitable for fine count spinning.

In each of the above embodiments, needle heads of the combing roller are arranged in a zigzag fashion as shown by FIG. 6C but it is possible to vary the needle heads arrangement by changing the needle plates which compose a needle plate laminated member or to make the needle head density greater by making a needle plate laminated member of needle plates with a plurality of needle heads (two–four needle heads). Also, the space between needles of a needle plate laminated member in the axial direction of the roller can be changed freely by changing the thickness of the needle plates or by interposing spacers of suitable thickness.

The connecting means 7 is composed of a band-like member 71 and adhesive 72 to fix the needle plate laminated member firmly, but the connecting member 71 can be replaced by a connecting member which is fitted tightly in a recess of groove shape in the needle plate laminated member, by pouring adhesive, lead, solder or the like for fastening without using a band-like member, by inserting a metal bar as a core member after pouring adhesive, by compressing and fitting a member for elastic material and the releasing or expanding it, by fitting a member made of a shape-memory alloy and then transforming it to the desired shape, and the like. Also, it is possible to provide only holes 51 as the receiving opening, dispensing with slits 52.

The combing roller according to the present invention is constituted as described above. Since the needle base portion and the needle insertion portion of the needle plate are symmetrical, needle plates can be stamped out accurately. Therefore, needle plate laminated members of a precise measurement which fit exactly in the groove of the roller body can be obtained. Also, as the needle plates laminated member is made by fitting a plurality of needle plates on a band-like member one by one with the latter as a guide, it is easy to manufacture. Since the group of needle insertion portions of the needle plate laminated member is fitted in the groove of dovetail shape of the combing roller, the needle plate laminated member does not slip off the roller body even during a high speed running of the combing roller and is maintained in proper fitting condition for a long period of time. Also, in the case where a needle plate laminated member is partly damaged, it is not necessary to replace a whole roller but it is possible to remove only the needle plate member containing the damaged part and replace it because in the combing roller according to the present invention, each needle row is removably mounted.

Furthermore, as it is possible to change the needle head pitch of the needle plate laminated member in the axial direction of the roller and in the direction of roller running, it is possible to improve the fiber opening function still further by replacing needle plate laminated members according to the spinning condition.

What is claimed is:

1. A combing roller comprising:

a roller body having in the circumferential surface thereof a plurality of dovetail-shaped grooves extending substantially parallel to the axis of said roller body and spaced at regular intervals around said roller body; and a plurality of needle plate laminated members removably fixed in said grooves; each needle plate laminated member having a plurality of needle plates each having a needle base portion with at least one needle head on the radially outer side thereof and a dovetail-shaped needle insertion portion on the radially inner side thereof with a receiving opening at the radially inner side of said needle insertion portion, said plates being in side by side relationship with said receiving openings aligned, and a connecting means extending through said receiving openings and holding said plates in side by side relation in said needle plate laminated member, said laminated needle plate members being held in said grooves against radial forces by the engagement of said needle insertion portions in said grooves.

2. A combing roller as claimed in claim 1 in which the grooves in the roller body each having a shape for tightly receiving therein the needle base portions and the needle insertion portions of the needle plates in the needle plate laminated members.

3. A combing roller as claimed in claim 1 in which the grooves in the roller body each having a shape for tightly receiving therein only the needle insertion portions of said needle plates in the needle plate laminated members.

4. A combing roller as claimed in claim 5 further comprising spacer plates between at least some of the adjacent needle plates in the needle plate laminated members.

5. A combing roller as claimed in claim 1 in which said connecting means comprises a band-like member made of metal or synthetic resin and extending through said openings and hardened adhesive holding said band-like member in place.

6. A combing roller as claimed in claim 5 in which said receiving opening comprises an aperture in said needle insertion portion and a slit opening out of the radially inner edge of said needle insertion portion from said aperture, and said band-like member extends through and fits tightly in said apertures and said slits are aligned to define a groove in the radially inner end of said needle plate laminated member, said adhesive filling said groove.

* * * * *